US008984692B2

(12) United States Patent
Balinski et al.

(10) Patent No.: US 8,984,692 B2
(45) Date of Patent: Mar. 24, 2015

(54) ACTIVE MOISTURE REMOVAL IN A LAUNDRY TREATING APPLIANCE

(75) Inventors: Barbara A. Balinski, Saint Joseph, MI (US); Karl D. McAllister, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 911 days.

(21) Appl. No.: 12/545,107

(22) Filed: Aug. 21, 2009

(65) Prior Publication Data

US 2011/0041562 A1 Feb. 24, 2011

(51) Int. Cl.
*D06F 35/00* (2006.01)

(52) U.S. Cl.
CPC ..... *D06F 35/008* (2013.01); *D06F 35/00* (2013.01)
USPC ..... 8/158; 8/149.1; 8/149.2; 8/149.3; 68/20; 68/13 R; 68/24; 68/12.01; 68/19.2

(58) Field of Classification Search
CPC ..... D06F 58/28; D06F 58/24; D06F 25/00; D06F 35/00; D06F 39/04
USPC ..... 34/474; 8/149.2, 158
See application file for complete search history.

(56) References Cited

U.S. PATENT DOCUMENTS

| | | | | |
|---|---|---|---|---|
| 4,922,624 | A * | 5/1990 | Tharpe | 34/475 |
| 5,029,458 | A * | 7/1991 | Obata et al. | 68/19.2 |
| 5,050,313 | A * | 9/1991 | Wakaeya et al. | 34/454 |
| 5,207,764 | A * | 5/1993 | Akabane et al. | 68/20 |
| 7,082,695 | B1 | 8/2006 | Wong et al. | |
| 2007/0151312 | A1 * | 7/2007 | Bruce et al. | 68/3 R |
| 2008/0078209 | A1 * | 4/2008 | Kim et al. | 68/4 |
| 2008/0178397 | A1 | 7/2008 | Im et al. | |
| 2008/0235977 | A1 * | 10/2008 | Kuwabara | 34/77 |
| 2008/0295696 | A1 * | 12/2008 | Kim | 96/417 |

FOREIGN PATENT DOCUMENTS

| | | | |
|---|---|---|---|
| EP | 0953315 | A1 | 11/1999 |
| JP | 6113993 | A | 4/1994 |
| JP | 2000000391 | A | 1/2000 |
| JP | 2004187843 | A | 7/2004 |

OTHER PUBLICATIONS

German Search Report for DE102010017104, Dec. 21, 2011.

* cited by examiner

*Primary Examiner* — Michael Barr
*Assistant Examiner* — Thomas Bucci

(57) ABSTRACT

A laundry treating appliance having a treating chamber for receiving laundry and configured to perform one or more cycles of operation and method for actively dehumidifying the treating chamber of a laundry treating appliance to retard or eliminate the adverse effects of moisture-laden laundry remaining in the treating chamber or moisture remaining in the treating chamber or other areas of the laundry treating appliance.

20 Claims, 5 Drawing Sheets

ACTIVE MOISTURE REMOVAL IN A LAUNDRY TREATING APPLIANCE

BACKGROUND OF THE INVENTION

Laundry treating appliances, such as clothes washers, clothes dryers, refreshers, and non-aqueous systems, have a treating chamber, which may have a configuration of a rotating drum, in which laundry items are placed for treating according to a cycle of operation. The laundry treating appliance may have a controller communicably and operably connected with the various components of the appliance for controlling the appliance to execute the cycle of operation. The cycle of operation may be selected manually by the user or automatically based on one or more conditions determined by the controller.

After the completion of the cycle of operation, the laundry may still contain moisture and/or there may still be moisture within the treating chamber or other areas of the appliance. If the moisture-laden laundry is left in the treating chamber too long, it may begin to mold or mildew, which may create a sour smell that most users find unpleasant. The moisture remaining within the treating chamber or other areas of the appliance may cause a similar result.

BRIEF DESCRIPTION OF THE INVENTION

The invention relates to an apparatus and method for actively dehumidifying the treating chamber of a laundry treating appliance to retard or eliminate the adverse effects of moisture-laden laundry remaining in the treating chamber or moisture remaining in the treating chamber or other areas of the appliance.

DESCRIPTION OF EMBODIMENTS OF THE INVENTION

Figure 1:
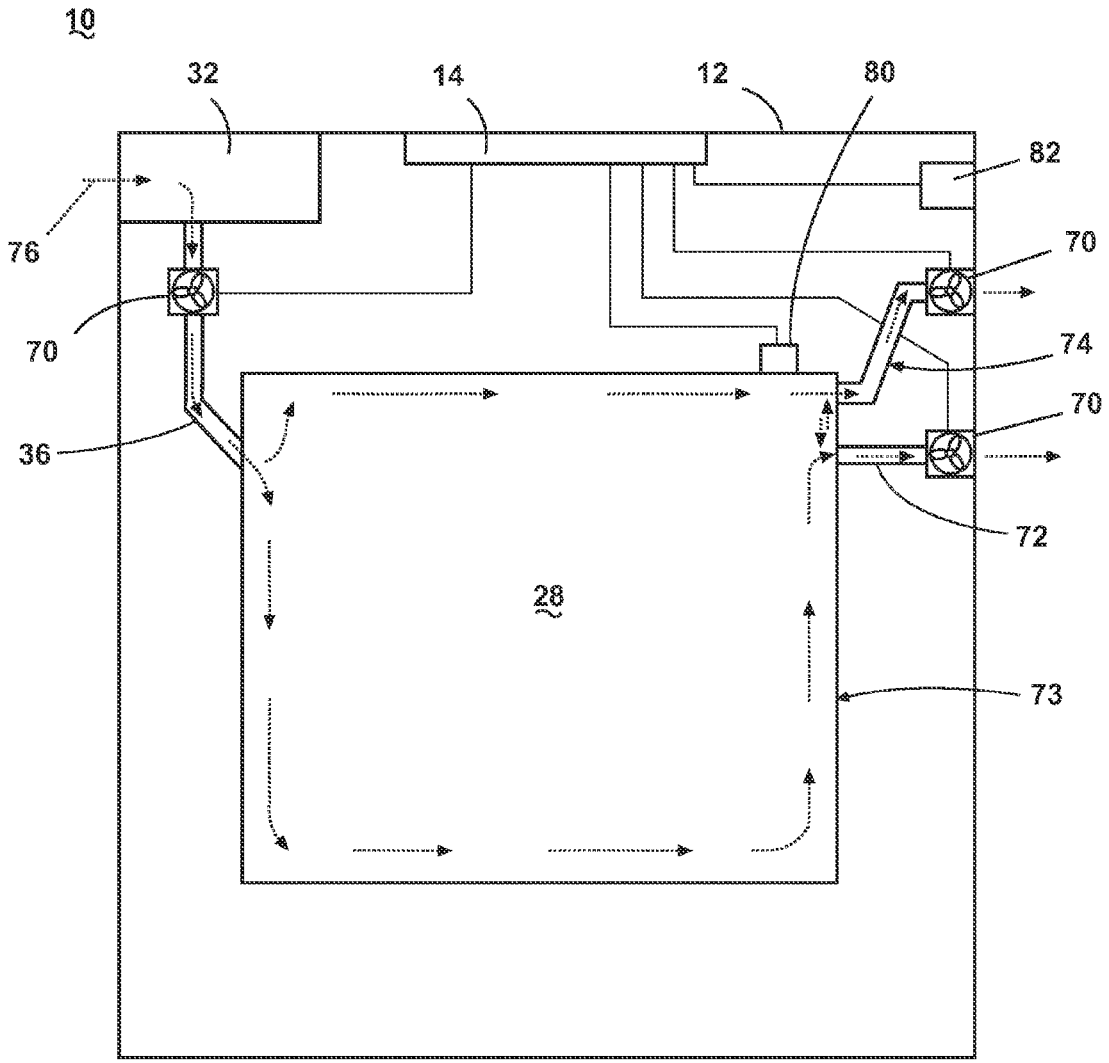
FIG. 1 is a schematic view of a laundry treating appliance according to a first embodiment of the invention.

FIG. 1 illustrates one embodiment of a laundry treating appliance according to the invention. The laundry treating appliance 10, according to the invention, may be any appliance which performs a cycle of operation on laundry, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance 10 may comprise a cabinet 12 in having a controller 14 for controlling the operation of the laundry treating appliance 10 to complete a cycle of operation. A treating chamber 28 may be located within the cabinet 12 for receiving laundry to be treated during a cycle of operation. A treatment dispenser 32 may be fluidly coupled with the treating chamber 28 through a dispensing conduit 36 and operably coupled to the controller 14 to deliver a treatment chemistry to the treating chamber 28 during a cycle of operation in response to instructions from the controller 14.

The laundry treating appliance 10 may further include a dehumidifying device 70, which is illustrated as a fan, for dehumidifying the air within the laundry treating appliance 10. The dehumidifying device 70 may dehumidify the air within the treating chamber 28 by venting and/or supplying air from the exterior of the treating chamber 28 to the interior of the treating chamber 28.

While the dehumidifying device 70 is illustrated as a fan, the dehumidifying device 70 may be any device and/or material capable of dehumidifying the air within the laundry treating appliance 10. Additional examples include a heat source, an evaporator, a condenser, or, a desiccant, for example. Any of these devices or materials may be used alone or in combination with another type of device or material. For example, the dehumidifying device 70 may include a fan for circulating air through the treating chamber 28 in addition to an incandescent light bulb for heating the contents of the treating chamber 28. In another example, the dehumidifying device 70 may include a fan and a heating element, such as a resistive heating element or light bulb, for heating air circulated by the fan. As used herein, the term dehumidify may refer to both removing moisture from the air, replacing the air with less humid air, and drying a surface as a result of removal of moisture and moisture-laden air from the surface and surrounding environment.

The number and location of the dehumidifying device 70 may be selected to achieve the desired flow of air through the treating chamber 28 and level of dehumidification. As illustrated in FIG. 1, one example of a suitable location for the dehumidifying device 70 is the dispensing conduit 36. The dehumidifying device 70 may be located within the dispensing conduit 36 for drawing air from the exterior of the treating chamber 28, including exterior of the laundry treating appliance 10, through the treatment dispenser 32 and into the treating chamber 28. The treatment dispenser 32 may be open to the ambient air surrounding the laundry treating appliance 10 such that the dehumidifying device 70 may draw in or exhaust air from the treating chamber 28 through the treatment dispenser 32.

In another example, the dehumidifying device 70 may be located within a vent tube, such as a child safety vent 74 that may exhaust to a rear side of the laundry treating appliance 10. In yet another example, the dehumidifying device 70 may be coupled with the treating chamber 28 through a separate dehumidifying conduit 72. The location of the dehumidifying device 70 may be selected to dry certain surfaces within the treating chamber 28 that are not normally cleaned during the wash process, such as the surfaces above the water fill line 73. One or more dehumidifying devices 70 may be coupled with the treatment chamber 28 such that air flows to these locations to ensure drying of these surfaces.

As illustrated by the arrows 76 in FIG. 1, one or more of the dehumidifying devices 70 may be operated such that air is drawn in from the exterior of the laundry treating appliance 10 through the treatment dispenser 32 and into the treating chamber 28 to replace the air within the treating chamber 28. The air from within the treating chamber 28 may then be exhausted to the rear of the laundry treating appliance 10 through the child safety vent 74 or the dehumidifying conduit 72. The dispensing conduit 36, the child safety vent 74 and/or dehumidifying conduit 72 may be provided with a dehumidifying device 70 either alone or in combination to facilitate the flow of air through the treating chamber 28.

For example, the dehumidifying device 70 within the child safety vent 74 may be operated to draw air from the exterior of the laundry treating appliance 10 through the treatment dispenser 32 and dispending conduit 32 into the treating chamber 28, where it may then be exhausted through the child safety vent 74. A dehumidifying device 70 may also be provided within the dispensing conduit 32 to facilitate the movement of air from the exterior of the laundry treating appliance 10 through the treatment dispenser 36. The process may also be operated in reverse such that air is drawn in through the child safety vent 74 and exhausted through the treatment dispenser 36.

Alternatively, rather than drawing and exhausting air to the exterior of the laundry treating appliance 10, air may be drawn in and/or exhausted into an interior space defined by the cabinet 12. It is also within the scope of the invention for the air to be drawn into the treating chamber 28 through a conduit other than the dispensing conduit 36 or any other suitable opening which fluidly couples the treating chamber 28 with the interior space defined by the cabinet 12 or the exterior of the laundry treating appliance 10.

In addition, the laundry treating appliance 10 may include one or more interior humidity sensors 80 for measuring the humidity within the treating chamber 28 and one or more exterior humidity sensors 82 for measuring the humidity of the environment in which the laundry treating appliance 10 is located. The interior and exterior humidity sensors 80 and 82 may be any suitable type of sensor or combination of sensors capable of determining relative or absolute humidity such as an infrared sensor, a capacitive sensor, a resistive sensor or a thermal conductivity sensor, for example. Alternatively, the interior and/or exterior humidity sensors 80, 82 may include a pressure and a temperature sensor for determining the dew point. The determined dew point may then be used to calculate the relative humidity.

The interior humidity sensor 80 may be located in any suitable location within the laundry treating appliance 10 for determining the humidity within the treating chamber 28. For example, the interior humidity sensor 80 may be located anywhere along the air flow path 76, such as in the treating chamber 28, the dispensing conduit 36, the child safety vent 74 and/or the dehumidifying conduit 72. It is within the scope of the invention for multiple humidity sensors 80 to be located at multiple locations within the laundry treating appliance 10.

The exterior humidity sensor 82 may be located anywhere in the cabinet 12 such that it may be able to determine the humidity of the environment in which the laundry treating appliance 10 is located.

As illustrated, the humidity sensors 80, 82 may be used to determine their respective internal/external humidity and output a signal indicative thereof. However, it is possible to use a single sensor that outputs a signal indicative of the difference between the internal/external humidity.

The controller 14 may be operably coupled with one or more components of the laundry treating appliance 10 for communicating with and controlling the operation of the component to complete a cycle of operation. For example, the controller 14 may be coupled with the treatment dispenser 32 for dispensing a treatment during a cycle of operation and the dehumidifying device 70 for dehumidifying the treating chamber 28.

The controller 14 may also be coupled with the interior humidity sensor 80 for determining the humidity within the treating chamber 28 and the exterior humidity sensor 82 for determining the humidity of the exterior environment. The sensor reading or readings in the form of a signal may be sent to the controller 14 and analyzed using analysis software provided to the controller to determine the humidity within the treating chamber 28. The signal may be analog, digital, continuous, or discontinuous. The signal may be indicative of an absolute value of the humidity or may be otherwise indicative of the humidity. For example, the output signal may be a voltage signal having an amplitude that is indicative of the absolute or relative humidity value. The type of the signal is not limiting. The controller 14 may then determine whether to activate or deactivate the dehumidifying device 70 based on the determined humidity within the treating chamber 28 and the humidity of the exterior environment.

Figure 2:
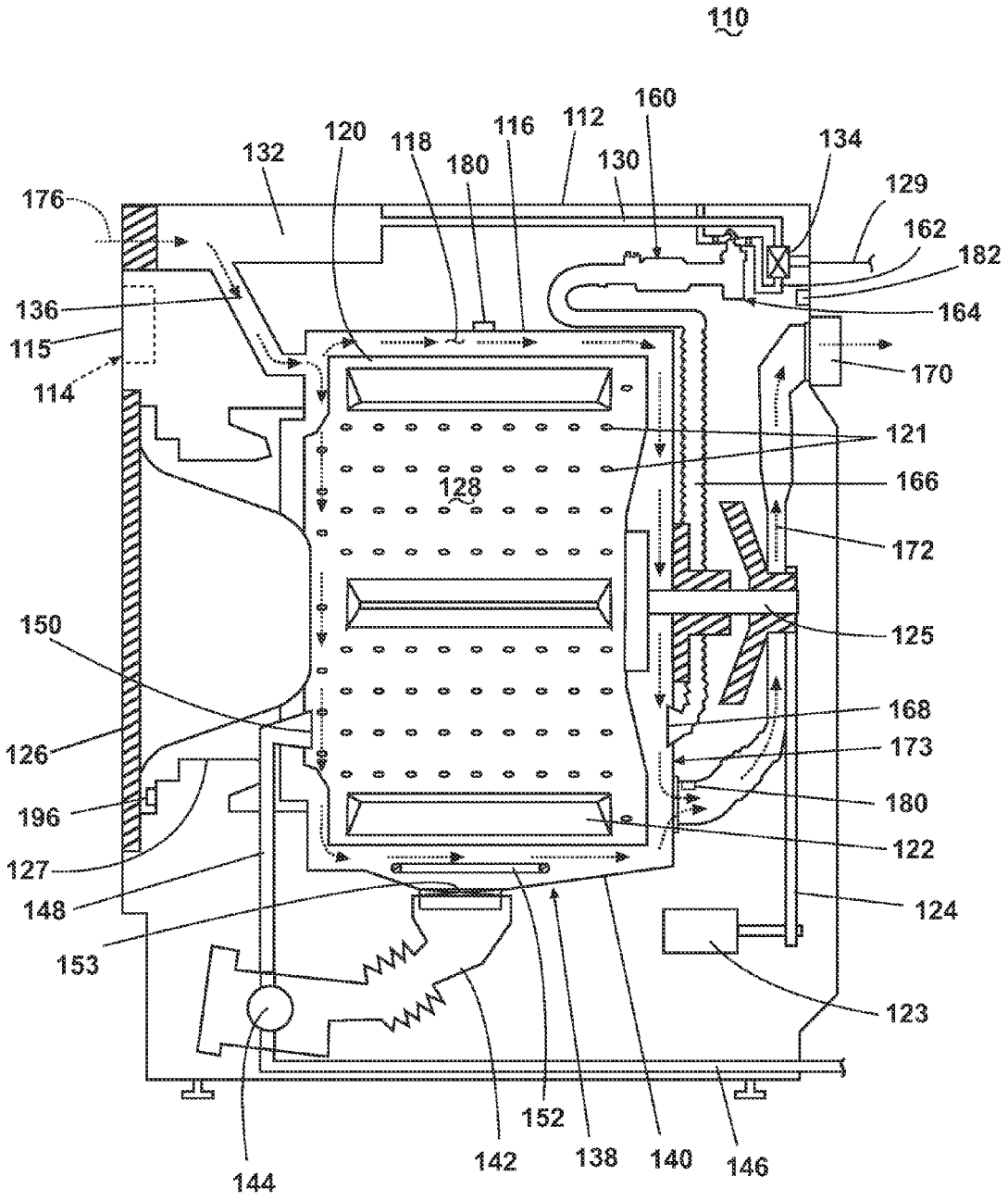
FIG. 2 is a schematic view of a laundry treating appliance according to a second embodiment of the invention.

FIG. 2 illustrates a second embodiment of the invention in the form of a washing machine 110 which is similar in structure to the laundry treating appliance 10. Therefore, elements in the washing machine 110 similar to the laundry treating appliance 10 will be numbered with the prefix 100. The washing machine 110 described herein shares many features of a traditional automatic washing machine, which will not be described in detail except as necessary for a complete understanding of the invention.

The washing machine 110 may comprise a cabinet 112 in which is provided a controller 114 that may receive input from a user through a user interface 115 for selecting a cycle of operation and controlling the operation of the washing machine 110 to implement the selected cycle of operation. A stationary tub 116 may located within the cabinet 112 and define an interior chamber 118.

A rotatable drum 120 may be located within the interior chamber 118 and may include a plurality of perforations 121. Liquid may flow between the tub 116 and the drum 120 through the perforations 121. The drum 120 may further include one or more lifters or baffles 122 disposed on an inner surface of the drum 120 to lift fabric items contained in the drum 120 while the drum 120 rotates. The drum 120 may define a treating chamber 128 for receiving fabric items to be cleaned.

The drum 120 may be rotated by a suitable drive mechanism, which is illustrated as a motor 123 coupled to the drum 120 through a belt 124 and a drive shaft 125. The motor 123 may be operably coupled to the controller 114 to control the rotation of the drum 120 to complete a cycle of operation. Other drive mechanisms, such as direct drive, may also be used.

Both the tub 116 and the drum 120 may be selectively closed by a door 126. A bellows 127 may couple an open face of the tub 116 with the cabinet 112, and the door 126 seals against the bellows 127 when the door 126 closes the tub 116.

While the drum 120 is illustrated and described herein as defining the treating chamber 128, the tub 116 and/or the drum 120 may be considered a receptacle, with either of them defining the treating chamber 128 for receiving fabric items to be treated. While the illustrated washing machine 110 includes both the tub 116 and the drum 120, it is within the scope of the invention for the laundry treating appliance to include only one receptacle, with the receptacle defining the treating chamber 128 for receiving the fabric items to be treated.

The washing machine 110 of FIG. 2 may further include a liquid supply and recirculation system. Liquid, such as water or water with a wash aid, may be supplied to the washing machine 110 from a water supply 129, such as a household water supply. A first supply conduit 130 may fluidly couple the water supply 129 to a treatment dispenser 132. An inlet valve 134 may control flow of the liquid from the water supply 129 and through the first supply conduit 130 to the treatment dispenser 132. A dispensing conduit 136 may fluidly couple the treatment dispenser 132 with the tub 116.

Liquid that flows from the treatment dispenser 132 through the flow conduit 136 to the tub 116 typically enters a space between the tub 116 and the drum 120 and may flow by gravity to a sump 138 formed in part by a lower portion 140 of the tub 116. The sump 138 may also be formed by a sump conduit 142 that may fluidly couple the lower portion 140 of the tub 116 to a pump 144.

The pump 144 may direct fluid to a drain conduit 146, which may drain the liquid from the washing machine 110, or to a recirculation conduit 148, which may terminate at a recirculation inlet 150. The recirculation inlet 150 may direct the liquid from the recirculation conduit 148 into the drum 120. The recirculation inlet 150 may introduce the liquid into the drum 120 in any suitable manner, such as by spraying, dripping, or providing a steady flow of the liquid.

Still referring to FIG. 2, the washing machine 110 may include a sump heater 152 which may be located in the sump 138. The sump heater 152 may be any type of heater and is illustrated as a resistive heating element for exemplary purposes. The sump 138 may also include a one-way check valve 153 for draining any liquid in the sump 138. The sump heater 152 may be used alone or in combination with a steam generator 160 to add heat to the chamber 20.

The washing machine 110 may optionally include a steam generation system including a steam generator 160 that may receive liquid from the water supply 129 through a second supply conduit 162, optionally via a reservoir 164. The inlet valve 134 may control flow of the liquid from the water supply 129 and through the second supply conduit 162 and the reservoir 164 to the steam generator 160. A steam conduit 166 may fluidly couple the steam generator 160 to a steam inlet 168, which may introduce steam into the tub 116. The steam that enters the tub 116 through the steam inlet 168 may subsequently enter the drum 120 through the perforations 121. Alternatively, the steam inlet 168 may be configured to introduce the steam directly into the drum 120.

The type of steam generation system is not germane to the invention and may include any type of steam generator 160 that converts liquid to steam. For example, the sump heater 152 may also be operated as a steam generator in place of or in addition to the steam generator 160.

The liquid supply and recirculation system and the steam generation system may differ from the configuration shown in FIG. 2, such as by inclusion of other valves, conduits, wash aid dispensers, and the like, to control the flow of liquid and steam through the washing machine 110 and for the introduction of more than one type of detergent/wash aid.

The washing machine 110 may further include a dehumidifying device 170, which is illustrated as a dehumidifying fan, for dehumidifying the air within the washing machine 110. The dehumidifying device 170 may dehumidify the air within the washing machine 110 by venting and/or supplying air from the exterior of the washing machine 110 to the tub 116. While the dehumidifying device is illustrated as a dehumidifying device 170, the dehumidifying device may be any device and/or material capable of dehumidifying the air within the washing machine 110. It is within the scope of the invention for other types of dehumidifying devices to be used such as those discussed above with respect to the laundry treating appliance 10 illustrated in FIG. 1.

The dehumidifying device 170 may be fluidly coupled with the tub 116 through a first ventilation conduit 172 for venting the interior of the tub 116 which includes the interior chamber 118 and the treating chamber 128. The treating chamber 128 may be fluidly coupled with the interior chamber 118 through the perforations 121 in the drum 120 such that air may flow between the two chambers.

In operation, the dehumidifying device 170 may draw in ambient air from the exterior of the washing machine 110 through the dispenser 132, as illustrated by arrows 176. The dispenser 132 may be provided such that the dispensing conduit 136 is fluidly connected with the ambient air exterior to the washing machine 110. The air flow 176 may be drawn into the tub 116 from the dispenser 132 through the dispensing conduit 136 that may be coupled with the tub 116 or the bellows 127. The air 176 drawn into the tub 116 may enter the interior chamber 118 and pass into the treating chamber 128 through the perforations 121 in the drum 120. The air may exit the treating chamber 128 in the same manner. The air may be withdrawn from the tub 116 through the ventilation conduit 172 and exhausted to the outside of the washing machine 110 through the dehumidifying device 170. In this manner, the dispenser 132, dispensing conduit 136, tub 116, drum 120, ventilation conduit 172 and dehumidifying device 170 provide a ventilation flow path for drawing ambient air into the tub 116 and exhausting air from the tub 116 to the exterior of the washing machine 110.

The dehumidifying device 170 may be operated such that air is drawn into the tub 116 through the treatment dispenser 132 and exhausted through the ventilation conduit 172 as illustrated by the arrows 176. Alternatively, the dehumidifying device 170 may be operated such that air is blown into the tub 116 through the ventilation conduit 172 and then exhausted through the treatment dispenser 132. It is also within the scope of the invention for a user to select the desired direction of the air flow through the washing machine 110 through the user interface 115.

The number and location of the dehumidifying device 170 may be selected to achieve the desired air flow path and level of dehumidification. For example, the location of the dehumidifying device 170 may be selected to dry certain surfaces of the tub 116 that are not normally cleaned during the wash process, such as the surfaces above the water fill line 173. One or more dehumidifying devices 170 may be coupled with the tub 116 such that air flows to these locations to ensure drying of these surfaces. Multiple dehumidifying devices 170 may also be provided to facilitate the movement of air through the washing machine 110. For example, an additional dehumidifying device 170 may be located within the dispensing conduit 136 to facilitate drawing air through the treatment dispenser 132.

Alternatively, rather than drawing and exhausting air to the exterior of the washing machine 110, air may be drawn in and/or exhausted into an interior space defined by the cabinet 112. It is also within the scope of the invention for the air to be drawn into the treating chamber 128 through a conduit other than the dispensing conduit 136 or any other suitable opening which fluidly couples the treating chamber 128 with the interior space defined by the cabinet 112 or the exterior of the washing machine 110.

In addition, the washing machine 110 may include one or more interior humidity sensors 180 for measuring the humidity within the tub 116 and one or more exterior humidity sensors 182 for measuring the humidity of the environment in which the washing machine 110 is located. The interior and exterior humidity sensors 180 and 182 may be any suitable type of sensor or combination of sensors capable of determining relative or absolute humidity such as an infrared sensor, a capacitive sensor, a resistive sensor or a thermal conductivity sensor, for example. Alternatively, the interior and/or exterior humidity sensors 180 and 182 may include a pressure and a temperature sensor for determining the dew point. The determined dew point may then be used to calculate the relative humidity.

The interior humidity sensor 180 may be located in any suitable location within the washing machine 110 for determining the humidity within the tub 116. For example, the interior humidity sensor 180 may be located anywhere along the air flow path 176, such as in the tub 116, the ventilation conduit 172 or the dispensing conduit 136. It is also within the scope of the invention for multiple interior humidity sensors 80 to be located at multiple locations along the air flow path 176.

The exterior humidity sensor 182 may be located anywhere in the cabinet 112 such that it may be able to determine the humidity of the environment in which the washing machine 110 is located.

Figure 3:
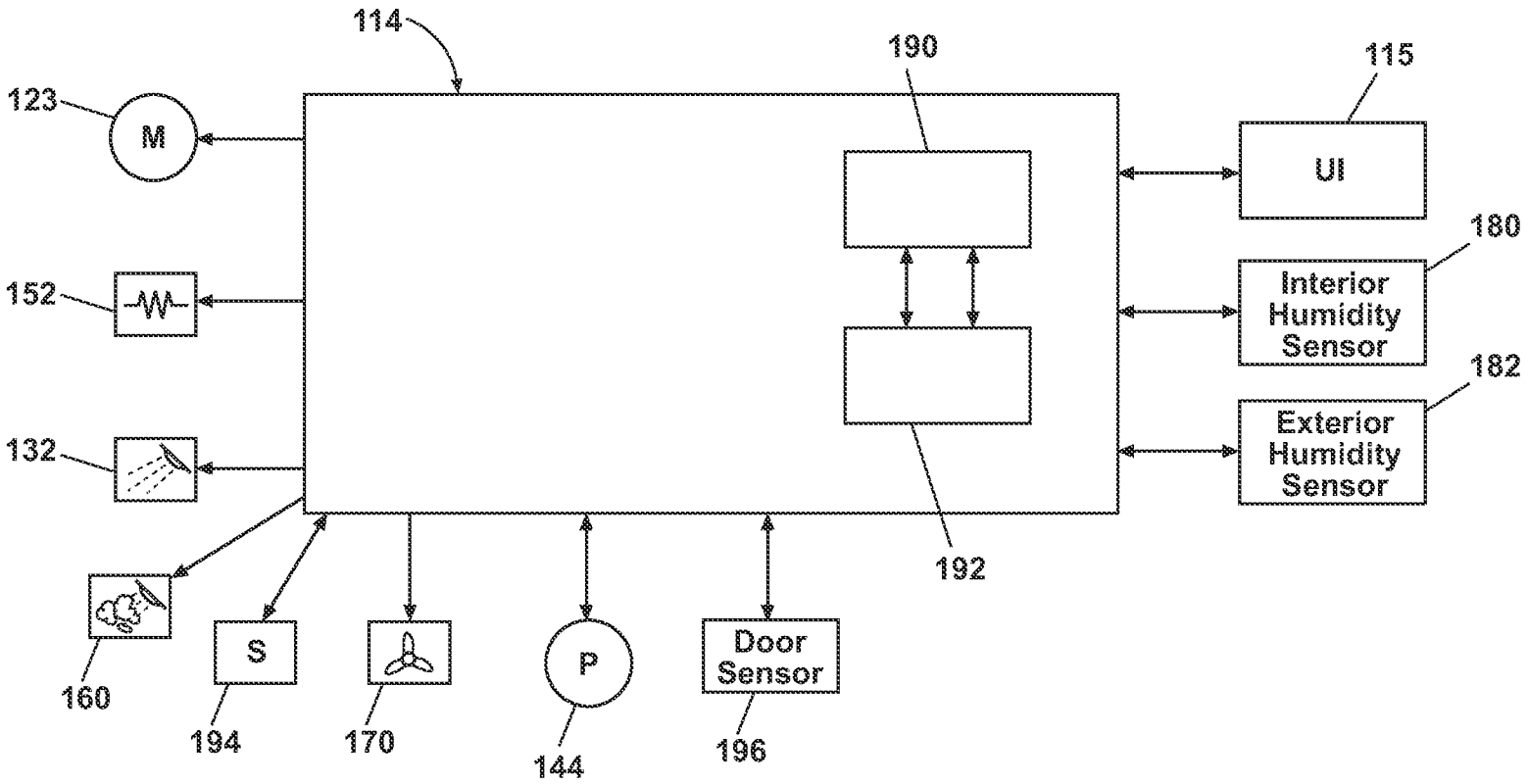
FIG. 3 is a schematic view of a control system of the laundry treating appliance of FIG. 2 according to the second embodiment.

As illustrated in FIG. 3, the controller 114 may be provided with a memory 190 and a central processing unit (CPU) 192. The memory 190 may be used for storing the control software that is executed by the CPU 192 in completing a cycle of operation using the washing machine 110 and any additional software, such as software for determining the size and type of the laundry, for example. The memory 190 may also be used to store information, such as a database or table, and to store data received from one or more components of the washing machine 110 that may be communicably coupled with the controller 114. It is also within the scope of the invention for the controller 114 to be used with the laundry treating appliance 10 according to the first embodiment of the invention.

The controller 114 may be operably coupled with one or more components of the washing machine 110 for communicating with and controlling the operation of the component to complete a cycle of operation. For example, the controller 114 may be coupled with the motor 123 for controlling the direction and speed of rotation of the drum 120; the treatment dispenser 132 or steam generator 160 for dispensing a treatment during a cycle of operation; the sump heater 152 for heating the wash liquid during a cycle of operation; the pump 144 for recycling liquid from the sump 38 back to the drum 120; and the dehumidifying device 170 for venting the tub 116. The controller 114 may also be coupled with the user interface 115 for receiving user selected inputs and communicating information to the user.

The controller 114 may also receive input from one or more sensors 194, which are known in the art and not shown for simplicity. Non-limiting examples of sensors 194 that may be communicably coupled with the controller 114 include: a treating chamber 128 temperature sensor, a moisture sensor, a load size sensor, and a motor torque sensor.

For example, the controller 114 may be communicably coupled with a door sensor 196 for determining when the door 126 is opened and closed. The door sensor 196 may be any suitable type of sensor such as a mechanical pressure sensor or a magnetic sensor, for example. Alternatively, the door sensor 196 may be an optical sensor having a light emitting and light detecting means for determining if the door 126 is open or closed. In another example, the door sensor 196 may be in the form of an imaging device, such as a camera, that is capable of determining if the door 126 is open or closed.

The controller 114 may also be coupled with the interior humidity sensor 180 for determining the humidity within the tub 116 and the exterior humidity sensor 182 for determining the humidity of the environment surrounding the washing machine 110. The sensor reading or readings may be sent to the controller 114 and analyzed using analysis software stored in the memory 190 to determine the humidity within the tub 116. The controller 114 may then determine whether to activate or deactivate the dehumidifying device 170 based on the determined humidity within the tub 116.

It is also within the scope of the invention for the interior and/or exterior humidity sensors 180, 182 to have a memory and a microprocessor for storing information and software and executing the software, respectively. In this manner, the interior and exterior humidity sensors 180 and 182 may analyze the data and communicate the results of the analysis with the controller 114.

The previously described laundry treating appliances 10 and 110 may be used to implement one or more embodiments of a method of the invention. Several embodiments of the method will now be described in terms of the operation of the washing machine 110. While the methods are described with respect to the washing machine 110, the methods may also be used with the laundry treating appliance 10 of the first embodiment of the invention. The embodiments of the method function to automatically determine the humidity within the tub 116 and control the operation of the dehumidifying device 170 based on the determination.

High humidity levels, such as above 50-70% relative humidity or higher, for example, may contribute to an increase in the growth of microorganisms in the laundry and within the washing machine 110. Under normal conditions and expected standards of operation, the high humidity levels are not reached. However, on some occasions, the user may forget to remove the laundry, causing the humidity in the treating chamber 128 to reach the high humidity levels. The growth of these microorganisms may generate an unpleasant odor that may permeate the laundry and pervade the washing machine 110. Operation of the dehumidifying device 170 to draw ambient air into the tub 116 and exhaust the air within the tub 116 to the exterior of the washing machine 110 may decrease the humidity of the environment within the tub 116, inhibiting the growth of these odor-producing microorganisms. The dehumidifying device 170 may also have an additional benefit of reducing the temperature of the laundry, which also facilitates the inhibition of the growth of microorganisms.

Figure 4:
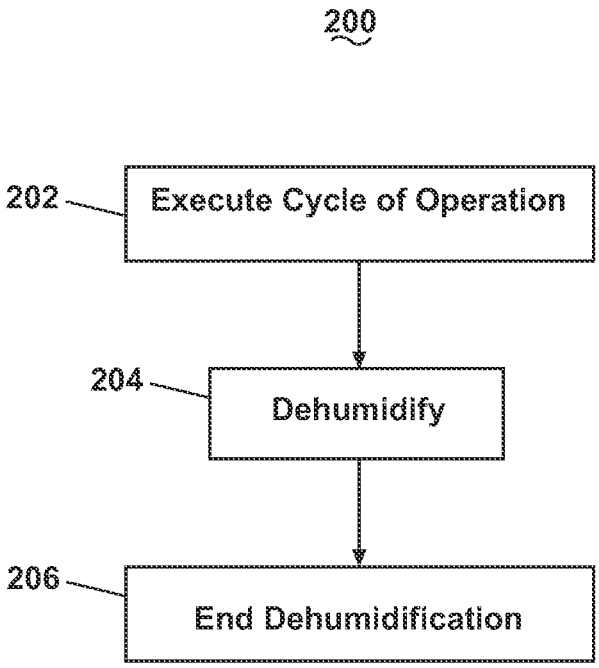
FIG. 4 is a flow chart illustrating a method for decreasing the humidity within a laundry treating appliance according to a third embodiment of the invention.

Referring now to FIG. 4, a flow chart of one embodiment 200 of the method for reducing the humidity within the tub 116 is disclosed. The sequence of steps depicted is for illustrative purposes only, and is not meant to limit the method 200 in any way as it is understood that the steps may proceed in a different logical order or additional or intervening steps may be included without detracting from the invention.

The method 200 starts at 202 during the execution of a cycle of operation. The cycle of operation may be any cycle of operation, including any one of the several well known cycles of operation, such as a wash cycle or refreshed cycle, to name a couple non-limiting examples. The dehumidifying process at 204 may be executed automatically by the controller 214 during or after the completion of the cycle of operation at 202 and may be initiated on a predetermined schedule following an event such as the selection of a cycle of operation or the closing of the door 126. At 206 the dehumidifying process may be terminated. This may occur when the internal humidity reaches a predetermined threshold or reference value, which may be related to the external humidity.

Figure 5:
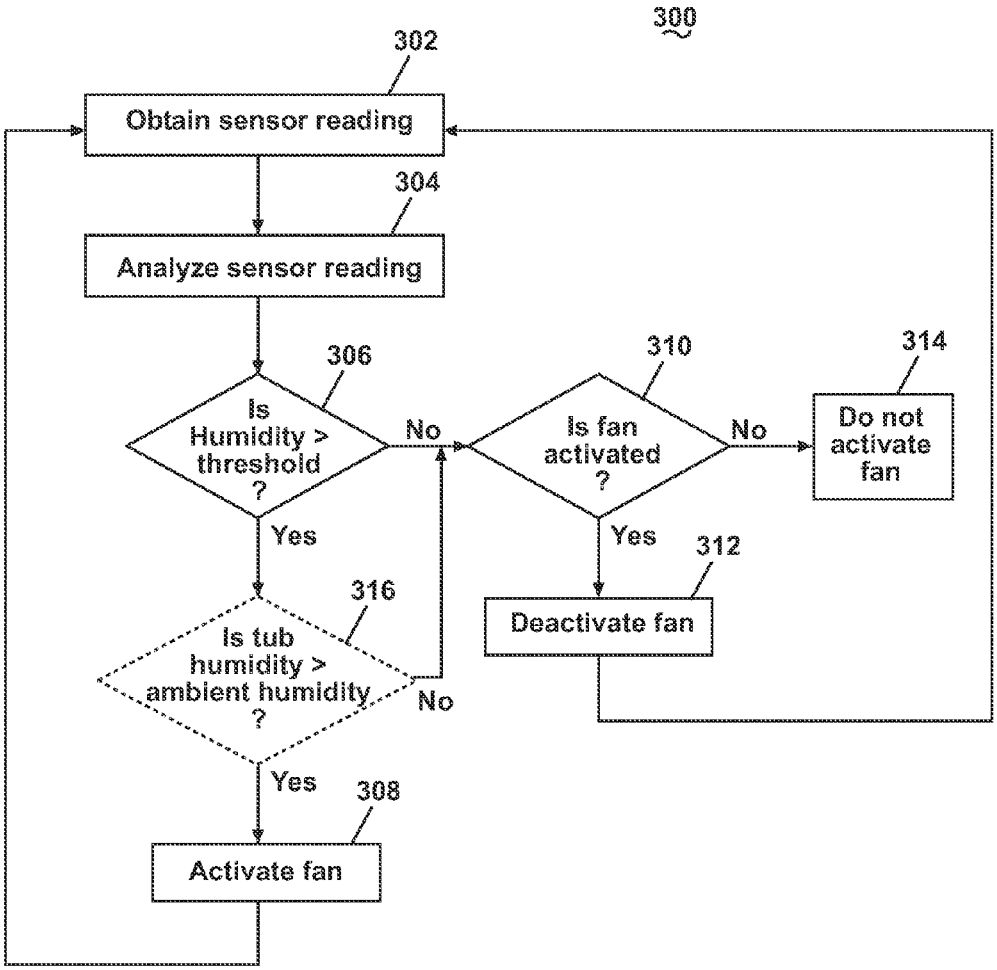
FIG. 5 is a flow chart illustrating a method for determining the humidity within a laundry treating appliance and controlling the operation of the laundry treating appliance in accordance with the determined humidity according to a fourth embodiment of the invention.

Referring to FIG. 5, a flow chart of one embodiment of a method 300 for dehumidifying the washing machine 110 is disclosed. The method 300 may be executed by the controller 114 during at 204 of the method 200 shown in FIG. 4. The sequence of steps depicted is for illustrative purposes only, and is not meant to limit the method 300 in any way as it is understood that the steps may proceed in a different logical order or additional or intervening steps may be included without detracting from the invention. The humidity is reduced by determining the humidity in the treating chamber and controlling the operation of the dehumidifying device 170 based on the determined humidity to reduce the humidity.

The method 300 starts at 302 by obtaining at least one sensor reading from the interior humidity sensor 180. The interior humidity sensor 180 may acquire a single reading or multiple readings. If the interior humidity sensor 180 acquires multiple readings, the readings may be processed, e.g. filtered or analyzed, before being communicated with the controller 114. The readings acquired at 302 may be sent to the controller 114 for analysis at 304 using software that is stored in the memory 190 of the controller 114.

At 306, the controller 114 may use the sensor data analyzed at 304 to determine if the humidity within the tub 116 is above a predetermined threshold value. If the humidity is equal to or above the predetermined threshold value, the dehumidifying device 170 may be activated at 308.

If the humidity is below the predetermined threshold value at 306, the controller 114 may determine if the dehumidifying device 170 is already running at 310. If the dehumidifying device 170 is already running, it may be deactivated at 312. If the dehumidifying device 170 is not running, the controller 114 may maintain the dehumidifying device 170 in its deactivated state at 314.

The method 300 at 302 through 314 may be repeated continuously or on a scheduled basis throughout the lifetime of the washing machine 110 or after an initiation event, such as the closing of the door 126 or the selection or completion of a cycle of operation. In this manner, the controller 114 may operate the dehumidifying device 170 only when the humidity value is above a predetermined threshold, such as 60% for example, to minimize the growth of odor-causing microorganisms within the tub 116. Operating the dehumidifying device 170 only when it is may also have the additional benefit of increasing the lifespan of the dehumidifying device 170.

Still referring to FIG. 5, the method 300 may also include an optional process 316 for comparing the measured humidity within the washing machine 110 determined in at 302 and 304 with the ambient humidity of the environment outside the washing machine 110. According to this embodiment of the invention, the washing machine 110 may include an additional exterior humidity sensor 182, which may be similar to interior humidity sensor 180, for measuring the ambient humidity. If the humidity in the washing machine 110 determined at 304 is greater than the ambient humidity, then the dehumidifying device 170 may be activated at 308. If the humidity in the washing machine 110 is less than or equal to the ambient humidity, the method may move to 110. Alternatively, the dehumidifying device 170 may be activated if the difference between the humidity within the washing machine 110 determined by the interior humidity sensor 80 and the humidity determined by the exterior humidity sensor 82 is equal to or larger than a predetermined threshold.

Optional process 316 may be beneficial in environments where warm and humid weather occurs. The operation of the dehumidifying device 170 alone will not be able to decrease the humidity within the tub 116 to a level less than the humidity of the environment surrounding the washing machine 110. Therefore, in an effort to reduce energy consumption and the expenditure of the lifespan of the dehumidifying device 170, 316 may be provided in the method 300 to only operate the dehumidifying device 170 when the conditions exist such that dehumidifying device 170 may reduce the humidity within the tub 116. This optional process addresses the occasions where the ambient humidity is greater than the threshold humidity making it impossible or impractical to reduce the humidity below the threshold value.

Several methods may be used to analyze the sensor readings at 304. If the interior humidity sensor 180 is an infrared humidity sensor, the interior humidity sensor 180 may determine the relative humidity and communicate the results directly with the controller 114. If the interior humidity sensor 180 consists of a pressure sensor and a temperature sensor, the pressure and temperature data obtained at 302 may be analyzed at 304 to determine the dew point temperature. The dew point temperature may be determined at 304 by consulting a look-up table stored in the controller memory 190 containing the dew point temperature for a given pair of pressure and temperature values. Alternatively, the dew point temperature may be determined by the controller 114 using a known function relating dew point temperature to pressure and temperature.

The controller 114 may then use the determined dew point temperature to determine the relative humidity within the tub 116. The relative humidity may be determined using an appropriate function relating the dew point temperature and measured temperature to the relative humidity or the controller 114 may consult a look-up table stored in the controller memory 190 containing values for relative humidity based on the dew point and measured temperature.

The exterior humidity sensor 182 may be used in the same manner as the interior humidity sensor 180 to determine the humidity of the environment exterior to the washing machine 110.

The dehumidification of the tub 116 by the dehumidifying device 170 may be facilitated by removing as much liquid as possible from the tub 116 and other components of the washing machine 110. One method to facilitate removal of liquid from the tub 116 may involve activating the pump 144 to pump away any liquid that remains or may accumulate over time in the lower portion 140 of the tub 116 after the completion of a cycle of operation. In systems that do not have a pump, such as a clothes dryer, for example, another method for decreasing the amount of water in the system may involve activating the one-way check valve 153 to drain any liquid that remains or may accumulate over time in the lower portion 140 of the tub 116 after the completion of a cycle of operation. The pump 144 or check valve 153 may be connected with the controller 114 such that it is activated at the same time as the dehumidifying device 170 or at the start of the method 100 illustrated in FIG. 5. In another example, the pump 144 may be activated to remove any water that accumulates in the lower portion 140 of the tub 116.

In another example, the washing machine 110 may be provided with a heat source, such as a resistive heating element or an incandescent light bulb, for example, that may promote the evaporation of any liquid remaining in the tub 116 or other components of the washing machine 110. The heat source may be connected with the controller 114 such that it is activated at the same time as the dehumidifying device 170. For example, the heat source may be activated at the same time as the dehumidifying device 170 to heat the air as it is drawn into the treating chamber 128.

In another example, the washing machine 110 may be provided with a condensing apparatus, such as a thermal electric cooler, for example, to promote condensation of moisture from the air. The condensing apparatus may promote removal of moisture from the air by cooling the air such that the moisture condenses. In another example, the condensing apparatus may promote the removal of moisture from the air by changing the pressure. The condensing apparatus may be fluidly coupled with the sump 142 such that the condensed moisture may be drained from the washing machine 110 by the pump 144.

Inhibiting the growth of microorganisms through the activation of the dehumidifying device 170 may also be facilitated by modifying existing cycles of operation or initiating additional cycles. For example, the growth of microorganisms is not only related to the humidity within the tub 116 but also to the water content of the laundry load. Existing cycles of operation may be modified such that the water content in the laundry at the end of the cycle is below a predetermined threshold value that may be determined empirically for different types of fabrics, fabric blends and fabric sizes and stored in the controller memory 190. Alternatively, the predetermined threshold value may be determined automatically based on the type of fabrics, fabric blends and fabric sizes according to an algorithm stored in the controller memory 190. The decrease in laundry water content and the decrease in tub humidity may both contribute to inhibiting the growth of microorganisms.

For example, it has been found that decreasing the water content in a load consisting of cotton fabrics to less than 15% in combination with active venting of the tub 116 by the dehumidifying device 170 is very effective at inhibiting the growth of microorganisms within the laundry when the laundry is left in the washing machine 110 for an extended period of time after the completion of a cycle of operation. The desired water content level that may be used in combination with active venting by the dehumidifying device 170 may vary depending on the type of fabric in the load. For example, to achieve the same level of inhibition of growth as the cotton load, the water content in a load of synthetic fabrics, such as polyester, may need to be as low as 4%.

The activation of the dehumidifying device 170 may also be combined with an additional tumble cycle after the completion of the user selected cycle of operation. Rotation of the drum 120 resulting in tumbling of the laundry load may facilitate evaporation of liquid from the laundry by exposing more of the surface of the laundry. In addition, tumbling of the laundry may contribute to the inhibition of growth by providing an unstable substrate (the laundry fabric) on which many microorganisms find it difficult to propagate. Evaporation of additional liquid from the laundry and subsequent removal of the humid air from the tub 116 by the dehumidifying device 170 may decrease the growth of odor-causing microorganisms in the laundry. Tumbling of the laundry load and activation of the dehumidifying device 170 may be used independently to inhibit the growth of microorganisms. Alternatively, the tumbling and the activation of the dehumidifying device 170 may be combined to provide an additive or synergistic effect to inhibit the growth of microorganisms. The rate and number of rotations of the drum 120 may be set such that the amount of mechanical damage to the load is less than the mechanical damage that occurs in the course of a cleaning cycle of operation.

The apparatus and methods described herein facilitate the inhibition of the growth of microorganisms that may generate unpleasant odors in the laundry load and laundry treating appliance. The use of humidity sensors to determine when to operate a dehumidifying process allows the process to be initiated based on the conditions within the system, not simply based on an event, such as the door remaining closed after the completion of the cycle of operation or an elapsed time. Condition variables such as the remaining moisture content of the load, the type of fabrics in the load, load size and the temperature of the final rinse cycle may all effect the growth rate of microorganisms. Operating the dehumidifying process based on an event such as elapsed time or the status of the door may not be able to account for the effect these variables have on the system. This may results in the dehumidifying process not being initiated in time to inhibit the growth of microorganisms and/or result in premature termination of the dehumidifying process before the humidity within the laundry treating appliance has been decreased to a level at which the growth of microorganisms is inhibited. The use of a humidity sensor allows the dehumidifying process to be initiated when it is needed, including during a cycle of operation, depending on the conditions within the system. The dehumidifying process may continue to operate until the conditions have changed such that the risk of the growth of microorganisms is significantly reduced or eliminated.

In addition, basing the dehumidifying process on whether or not the user opens the door after the completion of a cycle of operation only accounts for effects that the remaining moisture content in the load has on the growth of microorganisms, it does not account for the effects of moisture remaining in other parts of the washing machine. For example, moisture remaining in areas such as the dispensing system or surfaces of the tub that are not normally cleaned during a wash cycle may contribute to the growth of microorganisms in the laundry treating appliance that may lead to an unpleasant odor. The use of humidity sensors to determine if a dehumidifying process should be operated allows the process to be operated when it is needed based on the conditions in the laundry treating appliance that directly effect the growth of microorganisms, regardless of the status of the door or the presence of laundry within the system. In this manner, the growth of microorganisms both within the laundry and within the laundry treating appliance system may be inhibited.

An additional advantage of the use of humidity sensors to determine when to operate a dehumidifying process may be the increase in energy efficiency of the washing machine. An exterior humidity sensor may be used to determine the humidity of the environment exterior to the laundry treating appliance and the dehumidifying process may be operated accordingly such that energy is not wasted in an attempt to decrease the humidity within the laundry treating appliance to a level below the surrounding environment. This feature may be especially useful in environments where the weather may be hot and/or humid. Prior attempts to reduce the humidity in the treating chamber relied on time-based control of an exhaust fan. Such a time based approach tends to waste energy in humid environments as the fan continues to run without a further reduction in the internal humidity. The embodiments of the invention described herein address these shortcomings of the prior devices. In addition, operating the dehumidifying device only when needed may increase the lifetime of the device, providing increased cost savings and convenience to the user over the lifetime of the appliance.

While the different embodiments have been individually described, it is within the scope of the invention to combine the various elements of each embodiment with each other. Thus, the elements from all of the embodiments may be mixed or combined as desired. Elements in a single embodiment, not otherwise described as being combinable, may also be combined as desired.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A method of operating a laundry treating appliance having a cabinet in which is located a treating chamber for receiving laundry, and a closure element providing selective access to the treating chamber, the method comprising:

determining a humidity external to the treating chamber;

determining a humidity internal to the treating chamber; and reducing the humidity internal to the treating chamber by selectively generating one of a directional air flow in a first direction by supplying air from a front of the laundry treating appliance and exhausting air from a rear of the laundry treating appliance and a directional air flow in a second direction by supplying air from the rear of the laundry treating appliance and exhausting air from the front of the laundry treating appliance until the humidity internal to the treating chamber reaches a predetermined humidity, the predetermined humidity being a function of the humidity external to the treating chamber.

2. The method of claim 1, further comprising determining a difference between the humidity internal to the treating chamber and the humidity external to the treating chamber.

3. The method of claim 2 wherein the determining the difference comprises repeatedly determining the difference.

4. The method of claim 2, further comprising reducing the humidity internal to the treating chamber until the difference satisfies a predetermined threshold.

5. The method of claim 4 wherein the predetermined threshold comprises a difference value indicative of the difference between the humidity internal and external to the treating chamber.

6. The method of claim 5 wherein the difference value is greater than zero.

7. The method of claim 2 wherein the determining the difference comprises separately determining the humidity internal and external to the treating chamber and comparing the separately determined humidity internal and external to the treating chamber.

8. The method of claim 1 wherein the reducing the humidity internal to the treating chamber comprises at least one of exhausting air from the treating chamber and supplying external air into the treating chamber.

9. The method of claim 8 wherein reducing the humidity internal to the treating chamber further comprises operating a fan to create a pressure difference between the treating chamber and an atmosphere exterior to the treating chamber.

10. The method of claim 1 wherein the predetermined humidity is greater than the humidity external to the treating chamber and less than the humidity internal to the treating chamber.

11. The method of claim 1 wherein reducing the humidity internal to the treating chamber comprises condensing moisture in the air in the treating chamber.

12. The method of claim 1 wherein the directional air flow is selected by a user.

13. The method of claim 1, further comprising inhibiting a growth of odor-causing microorganisms.

14. The method of claim 13 wherein inhibiting the growth of odor-causing microorganisms comprises reducing the humidity within the treating chamber.

15. A method of operating a laundry treating appliance comprising a rotatable drum at least partially defining a treating chamber for receiving laundry for treatment in accordance with a cycle of operation, the cycle of operation including a supply of liquid to the treating chamber, a dispensing system fluidly coupled with the treating chamber for supplying a treatment chemistry to the laundry, and a closure element providing selective access to the treating chamber, the method comprising:

removing liquid supplied to the treating chamber during the cycle of operation by at least one of draining and pumping the supplied liquid;

determining a humidity external to the treating chamber;

determining a humidity internal to the treating chamber following the removal of the liquid; and after the removal of the liquid, reducing the humidity internal to the treating chamber by at least one of drawing ambient air into the treating chamber and exhausting air from the treating chamber through the dispensing system until the humidity internal to the treating chamber reaches a predetermined humidity, the predetermined humidity being a function of the humidity external to the treating chamber.

16. The method of claim 15 wherein reducing the humidity internal to the treating chamber comprises heating air within the treating chamber.

17. The method of claim 16 wherein the heating of air in the treating chamber comprises actuating a heat source fluidly connected with the treating chamber.

18. A method of operating a clothes washer comprising a tub defining an interior, with a drum rotatably mounted within the interior and at least partially defining a treating chamber for receiving laundry for treatment in accordance with a plurality of cycles of operation, with at least one of the cycles of operation including a wash cycle in which liquid is supplied to the treating chamber, a dispensing system fluidly coupled with the treating chamber for supplying a treatment chemistry to the laundry, and a closure element providing selective access to the treating chamber, the method comprising:

determining a humidity external to the treating chamber;

determining a humidity internal to the treating chamber following completion of the wash cycle; and after completion of the wash cycle, reducing the humidity internal to the treating chamber by drawing ambient air exterior to the tub through the treating chamber to dry exposed surfaces of the tub and the dispensing system until the humidity internal to the treating chamber reaches a predetermined humidity with moisture-laden laundry remaining in the treating chamber, the predetermined humidity being a function of the humidity external to the treating chamber.

19. The method of claim 18 further comprising rotating the drum while reducing the humidity.

20. The method of claim 19 wherein the rotating of the drum is continuous.

* * * * *